United States Patent [19]

O'Meara, Jr.

[11] 4,417,984

[45] * Nov. 29, 1983

[54] METHOD AND DEVICE FOR TREATING FLUIDS WITH MAGNETIC LINES OF FORCE

[76] Inventor: James R. O'Meara, Jr., P.O. Box 58170-MS-888, Houston, Tex. 77058

[ * ] Notice: The portion of the term of this patent subsequent to Sep. 15, 1998 has been disclaimed.

[21] Appl. No.: 301,696

[22] Filed: Sep. 14, 1981

Related U.S. Application Data

[63] Continuation-in-part of Ser. No. 151,864, May 21, 1980, Pat. No. 4,289,621.

[51] Int. Cl.[3] ..... C02B 1/48

[52] U.S. Cl. ..... 210/695; 210/222; 210/223

[58] Field of Search ..... 210/222, 223, 695

[56] References Cited

U.S. PATENT DOCUMENTS

| | | | |
|---|---|---|---|
| 3,680,705 | 8/1972 | Happ et al. | 210/222 |
| 4,278,549 | 7/1981 | Abrams et al. | 210/222 |
| 4,289,621 | 9/1981 | O'Meara | 210/222 |

*Primary Examiner*—Peter A. Hruskoci
*Assistant Examiner*—Sharon T. Cohen
*Attorney, Agent, or Firm*—Beveridge, DeGrandi & Kline

[57] ABSTRACT

A device and method for the treatment of a fluid with magnetic lines of force are disclosed. The device comprises an elongated outer casing and at least two spaced-apart elongated magnet assemblies positioned therein to form at least one laminar passageway for said fluid. Each magnet assembly comprises at least one tier of at least two permanent magnets or at least two magnetic sections of a single permanent magnet arranged in coaxial line in N—N and S—S relation. The ends of each tier of magnets or magnetic sections are supported by support members and, when said tier contains more than one magnet, the length of said tier is supported between its ends. The magnet assemblies are positioned so that the polarities of adjacent polar ends of magnets or magnetic sections in one of said magnet assemblies are unlike the polarities of the oppositely disposed adjacent polar ends of magnets or magnetic sections in a spaced-apart magnet assembly. The device and method are effective to reduce or inhibit the formation of scale in a system in which the treated fluid is used.

17 Claims, 7 Drawing Figures

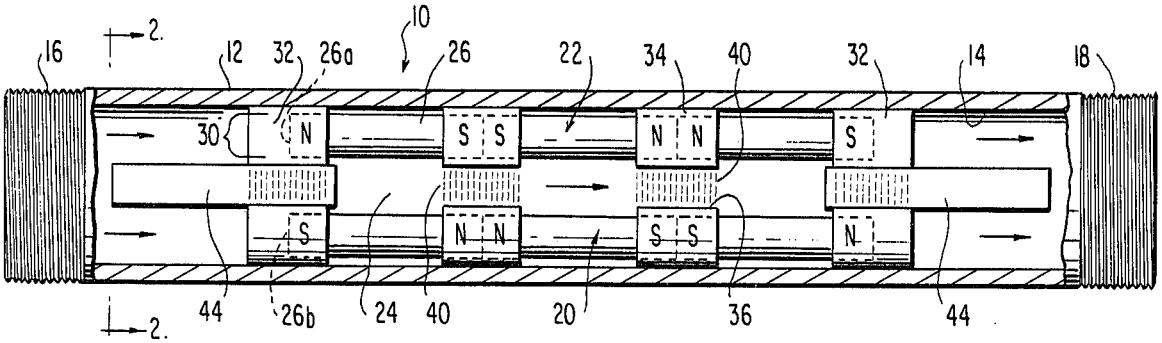
FIG.1
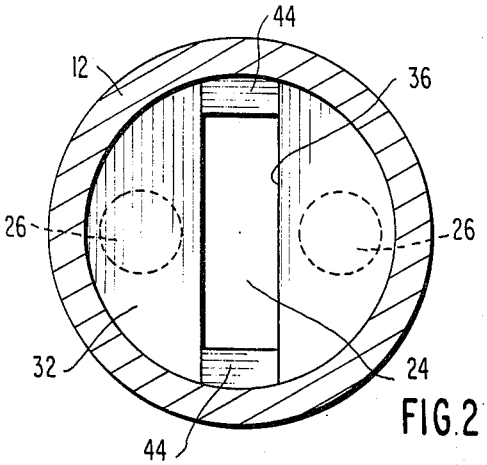
FIG.2
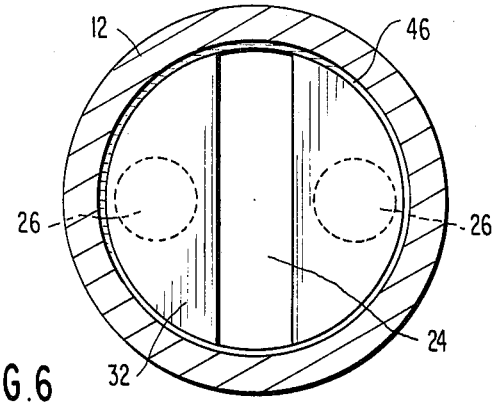
FIG.6
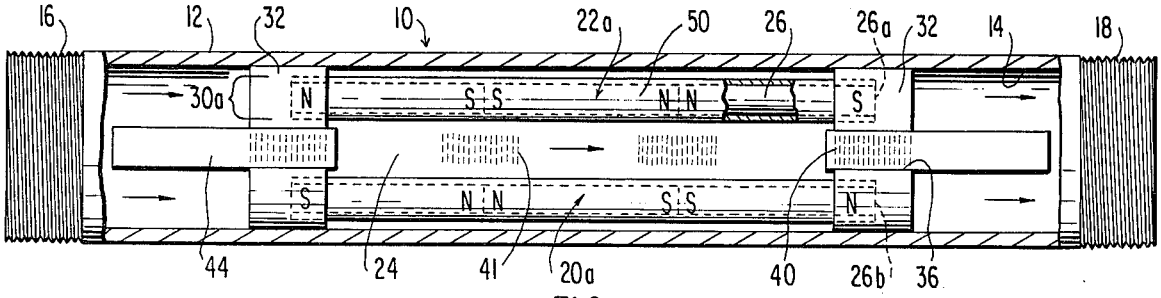
FIG.3
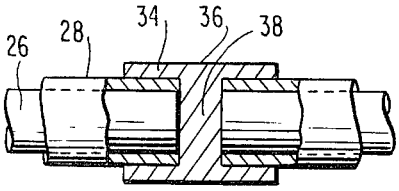
FIG.4
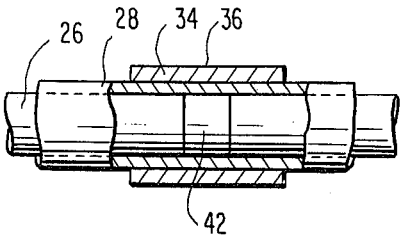
FIG.5
FIG.7
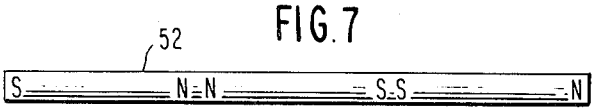

METHOD AND DEVICE FOR TREATING FLUIDS WITH MAGNETIC LINES OF FORCE

The present application is a continuation-in-part of my copending U.S. patent application Ser. No. 151,864 filed May 21, 1980, now U.S. Pat. No. 4,289,621.

The present invention relates to a method and device for the treatment of fluids by magnetic lines of force. More particularly, the present invention relates to a method and device for the magnetic treatment of liquids, and especially aqueous liquids which contain scale minerals, with concentrated high flux intersects to reduce or inhibit the formation of scale in a liquid, especially an aqueous liquid, system.

For many years, methods and devices and/or systems have been proposed which utilize the force fields of permanent magnets for the treatment of liquids and particularly aqueous liquids to reduce or eliminate the precipitation of calcium salts, magnesium salts and other mineral compounds therefrom and the adherence of the resulting precipitate as scale on heat transfer surfaces in boilers, heat exchangers and the like. Many attempts have been made to propose theories explaining the effect of the magnetic phenomena on these and other impurities contained in an aqueous liquid or other fluid. However, conclusive scientific evidence regarding the effect of the phenomena is minimal. It has been theorized that the effect of the magnetic field in reducing the formation of scale appears to be related to the onset of bulk crystallization of scale minerals upon a large number of microscopic nucleating centers that are formed when a fluid such as an aqueous liquid containing moderate or supersaturated proportions of scale salts flows through a magnetic field.

Even in the absence of conclusive evidence and explanation, numerous methods and devices have been proposed in the recent past for the purpose of treating water and other liquids in order to reduce and in some cases eliminate the need for added chemical dispersants and/or coagulants. These methods and devices have had varying degrees of success depending on their design and/or the understanding of the designer of magnetic principles and applications. Generally, the magnetic treatment of an aqueous liquid results in causing the materials that ordinarily form scale contained therein to form, instead, a loose slurry or sludge-like substance which can be easily removed from the aqueous liquid system by simple blowdown or flushing.

The methods and devices proposed to date are generally either of a complicated nature and expensive to use or fabricate or are of minimal effect in reducing the formation of scale.

Broadly, the device for the treatment of fluids with magnetic lines of force in accordance with my U.S. Pat. No. 4,289,621, the entire disclosure of which is incorporated herein by reference, utilizes a non-ferromagnetic outer casing to magnetically isolate magnet assemblies disposed therein so that lines of magnetic force are concentrated to achieve maximum force fields at selected points. This is accomplished by providing at least three spaced-apart magnet assemblies positioned in the outer casing to form fluid passageways. Each magnet assembly comprises at least one tier of at least two permanent magnets, each encased in a non-ferromagnetic jacket and arranged coaxially with like poles of magnets in the same tier being adjacent each other. The jacketed magnets have their ends supported by ferromagnetic support members which are magnetized with the polarity of the magnet ends supported thereby and the length of each tier of magnets is supported between its ends by at least one support member adjacent the ends of the magnets received therein. The polarities of support members in one magnet assembly are unlike those of oppositely disposed support members in an adjacent assembly.

While the device of my patent is highly effective and economical, it is limited as a practical matter by its construction to use in outer casings having internal diameters of about two inches or more. There has remained the need for a device and associated method which will be operable in conduits having internal diameters substantially less than two inches. There has also remained the need for a device which is even more economical in construction and use.

It is therefore a primary object of the present invention to provide further embodiments of my improved device and an associated method for the treatment of fluids with magnetic lines of force which are of increased simplicity and economy and are of desirably high efficiency.

It is another object of the present invention to provide such devices and associated method which utilize concentrated high flux intersects to reduce or eliminate scale-forming compounds from liquids containing them.

It is still another object of the present invention to provide such devices and associated method which are operable in conduits having internal diameters substantially less than two inches.

It has now been found that the above objects may be attained by a device containing only a minimum of two spaced-apart magnet assemblies. It has further been found that other features of the device of my U.S. Pat. No. 4,289,621, while still preferred, are not essential for successful operation of the device.

More particularly, it has been found that it is not essential that the outer casing be non-ferromagnetic. Similarly, it is not essential that each magnet in a magnet assembly be encased in a non-ferromagnetic jacket. Further, it has been found that it is not essential that the support members, and particularly the support members at the ends of the magnet assemblies, be ferromagnetic. Finally, it has been found that it is not essential that the length of each tier of magnets be supported between its ends by the means described and claimed in said patent or that each tier contains a plurality of individual permanent magnets.

Broadly, the device and associated method for the treatment of fluids with magnetic lines of force in accordance with the present invention utilize separate and magnetically isolated magnet assemblies defining a fluid passageway therebetween so that lines of magnetic force are concentrated in said passageway to achieve up to maximum force fields at selected points.

There are two distinct magnetic force fields generated by the device of the present invention. The minor force field is radial and is inherent in elongated and particularly in cylindrical magnets, i.e., a N/S attraction for each individual magnet. The primary magnetic force fields of the device and method of the present invention are generated by the polarities of adjacent polar ends of magnets or poles of magnetic sections in one magnet assembly being unlike the polarities of oppositely disposed polar ends of magnets or poles of magnetic sections in a parallel and spaced-apart magnet assembly positioned in the device. There are thus generated numerous high flux lines of magnetic force throughout the device which are concentrated at force field contraction points to intersect the aqueous liquid or other fluid flowing therethrough. Preferably, the aqueous liquid or other fluid passes through the device in at least one substantially laminar sheet whereby it intersects these primary high flux lines of magnetic force or force field contraction points at substantially right angles. The device of the present invention provides adjacent high flux lines of magnetic force or force field contraction points of unlike or reversed polarity whereby said contraction points present reversed magnetic lines of force between adjacent magnet sections of the device. This results in dipole realignment which causes added excitation of the microscopic nucleating centers within the fluid resulting in the attraction and alignment of like compounds and, when the fluid is a liquid, reduces their solubility therein. These induced energy characteristics within a supersaturated solution stimulate the microscopic nucleating centers therein and attract like compounds, thus altering their energy potential. The resulting charged and coagulated impurities remain in the flowing stream and (depending on the increase in temperature) refuse to adhere to any surface contacted by the stream. Multiple excitation and molecular realignment points are provided to accelerate the nucleating process. It has been found, in addition, that use of the device and method of the present invention tends to reduce or eliminate scale earlier deposited on surfaces contacted by the treated stream of fluid.

The present invention is further illustrated with reference to the annexed drawing wherein:

FIG. 1 is a top view of a fluid treatment device in accordance with the present invention showing the outer casing sectioned in part so as to expose the inner structure thereof;

FIG. 2 is a cross-sectional view taken along line 2—2 of FIG. 1 and viewed in the direction of the arrows;

FIG. 3 is a top view similar to FIG. 1 of another embodiment of the device of the present invention;

FIGS. 4 and 5 are enlarged fragmentary cross-sectional views of modified arrangements of the magnets within their jackets and support members;

FIG. 6 is a cross-sectional view similar to FIG. 2 illustrating a modified inner structure of the device of FIG. 1; and FIG. 7 is a side view of a single elongated magnet having a plurality of magnetic sections therein, which may be used in the devices of FIGS. 1–3.

Referring to the drawing and particularly to the embodiment of FIGS. 1 and 2, the fluid treating device 10 comprises an elongated hollow outer casing 12 having an inner surface 14. Casing 12 may be terminated at each end thereof by threaded end fittings 16 and 18 which define inlet and outlet openings for the entrance of fluid to be treated into device 10 and the exit of treated fluid therefrom. It is to be understood that threaded end fittings 16 and 18 are illustrative only and may be replaced by equivalent end fittings such as flanged end fittings, dresser couplings or the like which will provide a fluid tight seal with a conduit (not shown) which serves to feed fluid to be treated to device 10 and carry treated fluid therefrom. Outer casing 12 may preferably be formed of a non-ferromagnetic material such as 300 Series Stainless Steel or other non-ferromagnetic metallic or polymeric material. Alternatively, casing 12 may be formed of a ferromagnetic material such as cold steel, wrought iron or the like.

Within casing 12 are positioned two spaced-apart magnet assemblies, generally 20 and 22, each being coextensive in length and having a longitudinal axis substantially parallel with the longitudinal axis of casing 12 and with one another to define substantially laminar fluid passageway 24 therebetween. Although the flow of fluids is shown by arrows to go from left to right in FIG. 1, it is to be understood that said flow may be from right to left if desired. Each magnet assembly contains a plurality of permanent magnets 26 which are formed from a material having high flux density and high retentivity, for example, barium titanate, a ferrite compound such as barium ferrite, an alnico and the like, and magnetized along a given path therein as is well known in the art. In the embodiments shown in FIGS. 1–6, each magnet 26 is cylindrical and is magnetized along its longitudinal axis. When desired, magnet 26 may be encased in non-ferromagnetic jacket 28 (FIGS. 4 and 5) which may be formed of a non-ferromagnetic material, i.e., a metal such as brass or copper or the like or a polymeric material, such as rigid polyvinyl chloride, which is hard and wear-resistant, or the like.

Each magnet assembly in FIGS. 1 and 2 comprises at least one tier 30 of at least two magnets 26 arranged in a coaxial line with the magnets in the same tier having like poles adjacent to each other, i.e., in N—N and S—S relationship. The polarity at one end of each tier of magnets and, therefore, of each magnet assembly 20 and 22, may be either like or unlike the polarity at the other end thereof, depending on whether there is an odd or even number of at least two magnets 26 in each tier 30. In the embodiment shown in FIGS. 1 and 2, magnet assemblies 20 and 22 each contain one tier 30 of magnets 26. It is to be understood that while the device of the present invention as shown in FIGS. 1 and 2 comprises two magnet assemblies 20 and 22, each containing one tier 30 of three magnets 26, as is shown in my U.S. Pat. No. 4,289,621, devices containing more than two magnet assemblies, each containing at least two columns of more than one tier of at least two magnets, are contemplated within the scope of the invention.

The polar ends of magnets 26 are supported in inlet and outlet end support members 32 and internal support members 34. End support members 32 and particularly internal support members 34 may be formed of a ferromagnetic material such as cold steel, wrought iron or the like, and thus are magnetized by the magnets. In the alternative, end support members 32 and even internal support members 34 may be formed of a non-ferromagnetic material such as discussed above with relation to the preferred embodiment of outer casing 12. When a support member is non-ferromagnetic it is not magnetized by the polar ends of magnets received therein. In this case, when the length, i.e. the distance between the polar ends of a given magnet, one of whose ends is received in a non-ferromagnetic support member, is greater than the distance between the ends of said given magnet and the ends of a magnet received in the oppositely disposed support member in an adjacent magnet assembly, the device is still effective for the magnetic treatment of fluids since the primary magnetic field generated by the magnet ends received in the spaced-apart magnet supports as discussed above is greater than the minor radial force field inherent between the ends of each magnet. With reference to FIG. 1, the length of magnet 26 will provide a ratio, based on the distance between magnet ends 26*a* and 26*b*, within the scope of about 2:1 to 10:1 or more, preferably about 3:1 to 6:1, with a ratio of about 4:1 being highly preferred.

Support members 32 and, by inference, 34 are shown in FIG. 2 of the drawing as substantially conforming to the internal dimension of outer casing 12 and as being substantially in the shape of a sector of a disc. However, as fully explained in my U.S. Pat. No. 4,289,621, in devices which comprise two or more tiers of magnets in each magnet assembly, the support members may be of any desired shape, i.e., the members may be substantially hexagonal, cylindrical, rectangular, square, etc. in cross-section and may carry tapered or otherwise modified surfaces if desired. Preferably, the surfaces 36 of each end support member 32 of one magnet assembly, e.g. 20, and the facing surfaces 36 of the oppositely disposed end support members 32 of an adjacent magnet assembly, e.g. 22, are planar and substantially parallel to one another. In a further embodiment, surfaces 36 of all of support members 32 and 34 have this configuration. It is to be understood, however, that any one surface 36 may be either planar or non-planar irrespective of whether the facing surface 36 of an oppositely disposed support member is planar or non-planar.

Referring now particularly to the embodiment of FIG. 3, device 10 comprises outer casing 12 having inner surface 14 and threaded end fittings 16 and 18 with magnet assemblies generally 20*a* and 22*a* positioned therein defining fluid passageway 24. Each magnet assembly contains a plurality of permanent magnets 26 encased in a non-ferromagnetic sleeve 50 which may be formed of the same material as that described above for jacket 28. Each magnet assembly comprises at least one tier 30*a* of at least two magnets 26 encased in sleeve 50 and arranged in coaxial line as described above with regard to tier 30 of FIGS. 1 and 2.

The ends of tiers 30*a* are supported in inlet and outlet support members 32 which may be formed of ferromagnetic or non-ferromagnetic material and may have the shape all as described above with regard to FIGS. 1 and 2. The individual magnets 26, and thus the lengths of tiers 30*a*, are supported in sleeve 50. Thus, when support members 32 are non-ferromagnetic, the length of each magnet 26 will provide a ratio, based on the distance between magnet ends 26*a* and 26*b*, within the scope of about 2:1 to 10:1 or more, preferably about 3:1 to 6:1, with a ratio of about 4:1 being highly preferred.

Referring now particularly to FIG. 7, there is shown a single elongated permanent magnet 52 having a substantially homogeneous composition such as that of magnet 26 and magnetized along its longitudinal axis to provide a plurality of longitudinally spaced poles or polar ends of alternating polarity designated by the letters "N" and "S". In the embodiment shown, magnet 52 comprises four longitudinally spaced poles or polar ends which define three magnetic sections extending transversely throughout the magnet. The sections have their magnetic polarities or polar ends alternately and oppositely aligned whereby alternating north and south poles are provided in the magnet. This type of magnet may be produced by imposing a plurality of longitudinally displaced static magnetic fields of alternating polarity on a single length, e.g. a single bar, of magnetic material. For use in the device of the present invention, magnet 52 will contain at least three spaced poles or polar ends of alternating polarity to provide at least two magnetic sections. The polarity at one end of magnet 52 may be either like or unlike the polarity at the other end thereof depending on whether there is an odd or even number of magnetic sections provided therein, and may be either "N" or "S".

With regard to the device shown in FIG. 1, the magnets 26 in a single tier 30 may be replaced by a single magnet 52. Similarly, in the embodiment shown in FIG. 3, magnets 26 in a single tier 30*a* may be replaced by a single magnet 52, and sleeve 50 may be omitted, if desired. In this instance, when a support member 32 or 34 is formed of a non-ferromagnetic material, the length of a magnetic section of magnet 52 in one magnet assembly, e.g. 20 or 20*a*, will be greater by a ratio of between about 2:1 to about 10:1 or more, preferably about 3:1 to 6:1, most preferably about 4:1, than the distance between the polar ends of said magnetic section and the polar ends of a magnetic section received in the oppositely disposed support member in an adjacent magnet assembly, e.g. 22 or 22*a*.

As explained in my U.S. Pat. No. 4,289,621, when magnets 26 or 52 are of the preferred cylindrical shape shown in the drawing, each magnet assembly may contain a plurality of tiers 30 arranged one above another to form columns of individual magnets supported in support members 32 or 34. The number of tiers of magnets in each magnet assembly and the number of magnet assemblies in a device will be dependent, inter alia, on the shape and dimension of the magnets and support members, and the inner diameter of the outer casing. The number of magnets in each magnet assembly will be dependent, inter alia, upon the identity of the fluid being treated, the concentration of impurities contained in the fluid, and the physical characteristics of the fluid, e.g., viscosity, dielectric constant, etc. The magnet assemblies in the embodiments shown in FIGS. 1, 2 and 3, for example, can be received in an outer casing having an internal diameter of about two inches or less, and down to one inch or less. However, it is within the scope of the present invention to provide outer casings 12 having diameters of up to about twenty-four inches or more.

Each end support member 32 is shown in the drawing as counter-bored to receive and support the polar end of a single magnet 26 or 52 and, if used, jacket 28 or sleeve 50, or a single column thereof and, in the embodiment shown in FIGS. 1 and 2, the internal support members 34 are through-bored to receive and support abutting or contiguous like poles of adjacent magnets 26 or polar ends of the magnetic sections of magnets 52. When support members 32 or 34 are ferromagnetic they are magnetized with the polarity of the polar ends of magnets 26 or magnetic sections of magnets 52 received therein and the magnetic energy is distributed to surfaces 36. This results in a maximum concentration of the lines of magnetic force at said surfaces 36 which become force field contraction points to achieve maximum force fields 40 between oppositely disposed support members 32 or 34 of adjacent magnet assemblies. On the other hand, when support members 32 or 34 are non-ferromagnetic, they are not magnetized by the magnets received therein. However, force fields 40 are still produced, although of somewhat reduced energy, by the close proximity of the oppositely disposed support members in adjacent magnet assemblies. Similarly, in the embodiment shown in FIG. 3, force fields 41 are produced by the close proximity of the adjacent polar ends of magnets 26 or magnetic sections of magnets 52 in magnet assemblies 20*a* and 22*a*.

It is to be understood that other equivalent means may be used to adapt support members 32 and 34 to receive magnets 26 or 52 and, when used, jackets 28 or sleve 50 therein so long as the polar ends of magnets 26 or 52 are in efficient magnetic field termination with said support members or with adjacent polar ends of magnets or magnetic sections within said support members, e.g. routing of the support members, ground jointing of the magnets with the support members, etc. Other preferred means to achieve efficient magnetic field termination are more fully discussed hereinafter.

In the embodiment shown in FIG. 1, the magnets 26 in each tier 30 are contiguous. In the embodiment shown in FIG. 4, magnets 26 and jackets 28 are terminated with like magnet poles of magnets 26 received in opposed counter-bores in an internal support member 34 leaving portion 38 of internal support member 34 lying between and contiguous with the polar ends of magnets 26. The arrangement shown in FIG. 4 results in the most effective manner for uniformly distributing magnetic energy, i.e. magnetic lines of force, from the polar ends of magnets 26 to the surfaces 36 of support members 34. In the further embodiment shown in FIG. 5, support member 34 is through-bored and receives jacket 28 within which like magnet polar ends of magnets 26 are separated by a contiguous spacer 42 formed of a ferromagnetic material such as cold steel, wrought iron, etc. Spacer 42 also serves to uniformly distribute the magnetic energy from the polar ends of magnets 26 to surfaces 36 as described above. Any of these three arrangements of polar ends of magnets 26 with or without jackets 28 within internal support members 34 may be utilized in the device shown in FIG. 1 as may other arrangements as discussed above which are effective in uniformly distributing magnetic energy from magnets 26 to surfaces 36.

In the embodiment of FIG. 3, the magnets 26 in each tier 30*a* are also shown as contiguous within sleeve 50. However, similarly to the modification shown in FIG. 5, like polar ends of magnets 26 may be separated by contiguous spacer 42 formed of a ferromagnetic material.

The magnet assemblies 20 and 22 shown in FIG. 1 are assembled and positioned within outer casing 12 so that the polarity of each support member 32 and 34 in any one of said magnet assemblies is unlike the polarity of the oppositely disposed support member 32 or 34 in an adjacent magnet assembly. As seen in FIG. 1, the polarity of any given support member 32 or 34 in magnet assembly 20 is unlike the polarity of the oppositely disposed support member 32 or 34 in magnet assembly 22. Magnet assemblies 20*a* and 22*a* shown in FIG. 3 may be assembled and positioned within outer casing 12 in a similar manner whereby the polarity of each support member 32 and of each set of adjacent polar ends of magnets 26 or magnetic sections of magnets 52 in any one of said magnet assemblies, e.g., 20*a*, is unlike the polarity of the oppositely disposed support member 32 or set of adjacent polar ends of magnets 26 or magnetic sections of magnets 52 in an adjacent magnet assembly, e.g., 22*a*.

Means are provided for magnetically isolating magnet assemblies 20 and 22 or assemblies 20*a* and 22*a* from one another. As seen in FIGS. 1, 2 and 3, separating plate 44 which is formed of a non-ferromagnetic metal such as copper, brass, 300 Series Stainless Steel and the like, or other non-ferromagnetic material of sufficient strength, is fixedly attached to oppositely disposed support members 32 of the magnet assemblies whereby said support members and magnet assemblies are spaced apart. The attachment may be achieved by any known means such as brazing or the like. If desired, internal support members 34 in FIG. 1 may also carry plates 44 in the same or a similar manner.

As seen in FIG. 2, separating plate 44 is contiguous with inner surface 14 of outer casing 12 and may be attached thereto by any means known to the art. Alternatively, plate 44 may be spaced from outer casing 12. Other means may also be provided for fixedly positioning the magnet assemblies 20 and 22 or assemblies 20*a* and 22*a*, spaced apart by separating plates 44, within outer casing 12. These are fully described in my U.S. Pat. No. 4,289,621.

In the embodiment shown in FIG. 6, support members 32 of magnet assemblies 20 and 22 are curved to conform to the inner surface of outer casing 12 to allow maximum liquid flow through passageway 24. In this embodiment also, support members 32 of magnet assemblies 20 and 22 are fixedly attached to the inner surface 14 of outer casing 12. While FIG. 6 shows ring 46 attaching only one set of end support members 32, it is to be understood that rings 46 will also be provided in like manner for both sets of end support members 32. Rings 46 are non-ferromagnetic and are formed of the same materials as plates 44. Ring 46 may be attached to outer casing 12 as discussed above with regard to plate 44 in FIGS. 1 and 2. Ring 46 may also be replaced by a non-ferromagnetic sleeve (not shown) extending the full length of magnet assemblies 20 and 22.

Separating ring 46 may also be used in the embodiment shown in FIG. 3, in which case each support member 32 of magnet assemblies 20*a* and 22*a* is fixedly attached to the inner surface of ring 46 which is contiguous with the inner surface 14 of outer casing 12.

The spacing between magnet assemblies 20 and 22 or assemblies 20*a* and 22*a* and, where applicable, between each of the magnet assemblies and outer casing 12 may be varied within certain criteria. It is important that the opposing surfaces 36 or opposing magnet or magnetic section ends in adjacent magnet assemblies by sufficiently close that the force fields therebetween remain effective for the intended purpose and that the fluids passing through passageway 24 be sufficiently confined. It is also important, however, that sufficient flow of fluid through the device be maintained to prevent too high or severe a pressure drop.

In the device and method of the present invention when outer casing 12 is ferromagnetic and/or magnets 26 or 52 are not encased in non-ferromagnetic jackets 28 or sleeve 50, and/or support members 32 and/or 34 are non-ferromagnetic and/or the length of each tier 30 of magnets 26 or magnet 52 is supported between its ends by sleeve 50 rather than internal support members 34, the efficiency may be somewhat diminished. To increase efficiency, a greater number of magnets, or tiers of magnets or of magnet assemblies may be used. In the alternative or in addition, outer casing 12 may be made non-ferromagnetic and/or magnets 26 or 52 may be encased in non-ferromagnetic jackets 28 or sleeve 50 and/or support members 32 and/or 34 may be made ferromagnetic and/or the length of each tier 30 of magnets may be supported by internal support members 34. One or more of these expedients may be used depending on the increase in efficiency desired and the particulars of the system in which the device is to be incorporated.

Optionally and preferably, the magnet assemblies 20 and 22 or assemblies 20*a* and 22*a* are assembled with plates 44 or ring 46 and this assembled magnet unit is treated to minimize or eliminate the effect of galvanic corrosion which might normally occur between dissimilar metals. This may be accomplished, for example, by spraying or dipping the assembled unit in a coating material such as zinc, an opoxy resin, an elastomer or any other suitable material. Following this, the assembled unit is affixed in outer casing 12 and again treated as described above as a completed device 10 to cover any imperfections which may occur during installation, for esthetic reasons or for adapting the device for use with a particular fluid. While in the drawing support members 32 and 34, separating plate 44 and separating ring 46 are shown as abutting or in contiguous relation with inner surface 14 of outer casing 12, it is to be understood there will be a slight tolerance to allow for insertion of the assembled magnet unit into the casing prior to its being fixedly attached thereto as described hereinbefore.

In operation, fluid to be treated is supplied to device 10 through a conduit, not shown. The fluid enters outer casing 12 and, when the fluid contacts device 10, it is directed into passageway 24 with its attendant force fields, thus altering the flow path of the fluid and promoting molecular alignment of compounds contained therein. As the resulting laminar sheet of fluid traverses concentrated high flux intersects or force fields 40 and 41 of alternating N—S and S—N lines of magnetic force at substantially right angles, the microscopic nucleating centers are excited. This results in attraction and alignment of like compounds contained in the fluid and the formation of coagulated impurities which remain in the flowing stream.

Thus, the method for treatment of fluids with magnetic lines of force in accordance with the embodiments of FIGS. 1–6 comprises /directing the fluid through at least one passageway defined by the spaced-apart and longitudinally coextensive magnet assemblies, each assembly comprising at least one tier of at least two permanent magnets arranged in coaxial line with like poles adjacent each other. The magnet assemblies are positioned so that the polarities of adjacent polar ends of magnets in one of said magnet assemblies are unlike the polarities of the oppositely disposed polar ends of magnets in a spaced-apart magnet assembly. Similarly, the method for treatment of fluids with magnetic lines of force in accordance with the embodiments wherein individual permanent magnets 26 have been replaced by the single permanent magnet 52 shown in FIG. 7 comprises directing the fluid through at least one passageway defined by the spaced-apart and longitudinally coextensive magnet assemblies, each assembly comprising at least one tier of at least one permanent magnet magnetized along its longitudinal axis to provide a plurality of longitudinally spaced poles of alternating polarity defining at least two magnetic sections in coaxial line in said tier. The magnet assemblies are positioned so that the polarities of the poles of the magnetic sections in one of said magnet assemblies are unlike the polarities of the oppositely disposed poles of magnetic sections in a spaced-apart magnet assembly.

Device 10 is preferably contained in a closed system with a boiler, heat exchanger or the like. As the fluid makes repeated passes through device 10, the amount of coagulated impurities will increase and may be removed from the system at any desired time. While the device of the present invention is especially suited for fluids such as calcareous aqueous liquids, the device may be modified for use with other liquids or with gases in related fields including hyperfiltration of effluents, oil and gas well drilling applications, crude oil collection systems, etc.

In the foregoing description and throughout the specification and claims, the term "ferromagnetic" is used to describe materials having a high magnetic permeability and saturation point and which are attracted to a magnet, i.e. such materials as iron, nickel, cobalt, etc.

What is claimed is:

1. A device for the treatment of fluids with magnetic lines of force comprising:

an elongated hollow outer casing having a longitudinal axis and fluid inlet and outlet means at the longitudinal ends thereof;

at least two spaced-apart and longitudinally coextensive elongated magnet assemblies, each positioned within said outer casing and having a longitudinal axis substantially parallel with that of adjacent magnet assemblies and with the longitudinal axis of said outer casing to form at least one elongated laminar passageway for said fluid therebetween;

each of said magnet assemblies comprising at least one tier of at least two permanent magnets, each magnet being magnetized along its longitudinal axis and arranged in a coaxial line with the other magnet or magnets in the same tier with like polar ends of said magnets adjacent each other;

each of said tiers having one end supported by an inlet end support member and its other end supported by an outlet end support member, the length of each tier of magnets being supported between its ends by means associated with said end support members;

said magnet assemblies being positioned so that the polarities of adjacent polar ends of magnets in one of said magnet assemblies are unlike the polarities of the oppositely disposed adjacent polar ends of magnets in a spaced-apart magnet assembly, thereby providing at least three concentrated flux lines of magnetic force and adjacent flux lines of reversed polarity in each said passageway; and means for fixedly positioning said magnet assemblies within said outer casing.

2. The device according to claim 1 wherein the length of said tier is supported by a sleeve: encasing the magnets therein and operatively associated with said end support members.

3. A device for the treatment of fluids with magnetic lines of force comprising:

an elongated hollow outer casing having a longitudinal axis and fluid inlet and outlet means at the longitudinal ends thereof;

at least two spaced-apart and longitudinally coextensive elongated magnet assemblies, each positioned within said outer casing and having a longitudinal axis substantially parallel with that of adjacent magnet assemblies and with the longitudinal axis of said outer casing to form at least one elongated laminar passageway for said fluid therebetween;

each of said magnet assemblies comprising at least one tier of at least two permanent magnets, each magnet being magnetized along its longitudinal axis and arranged in a coaxial line with the other magnet or magnets in the same tier with like poles of said magnets adjacent each other;

each of said tiers having one end supported by an inlet end support member and its other end supported by an outlet end support member, the length of each tier of magnets being supported between its ends by at least one internal support member adjacent the ends of the magnets received therein;

said magnet assemblies being positioned so that the polarities of the magnet ends supported in the support members in one of said magnet assemblies are unlike the polarities of the magnet ends supported in the oppositely disposed support members in an adjacent magnet assembly, thereby providing at least three concentrated flux lines of magnetic force and adjacent flux lines of reversed polarity in each said passageway; and means for fixedly positioning said magnet assemblies within said outer casing.

4. The device according to claim 1 or 3 wherein the outer casing is non-ferromagnetic.

5. The device according to claim 3 wherein each magnet is encased in a non-ferromagnetic jacket.

6. The device according to claim 3 wherein each said internal support member is ferromagnetic whereby it is magnetized with the polarity of the magnet ends supported thereby.

7. The device according to claim 1 or 3 wherein each said end support member is ferromagnetic whereby each is magnetized with the polarity of the magnet end supported thereby.

8. The device according to claim 3 wherein each said end support member is non-ferromagnetic and wherein the distance between the ends of a magnet received in a non-ferromagnetic support member is greater than the distance between said magnet ends and the magnet ends received in the oppositely disposed support member in an adjacent magnet assembly.

9. The device according to claim 8 wherein all of said support members are non-ferromagnetic.

10. The device according to claim 1 wherein each said end support member is non-ferromagnetic and wherein the distance between the end of a magnet received in a non-ferromagnetic support member is greater than the distance between said magnet end and the magnet end received in the oppositely disposed support member in an adjacent magnet assembly.

11. The device according to claim 1 or 3 wherein each of said tiers contains at least three permanent magnets.

12. The device according to claim 3 wherein said internal support member is adapted to receive and support like poles of adjacent magnets with a portion of said internal support member lying between and contiguous with the polar ends of said magnets.

13. The device according to claim 3 wherein said internal support member is adapted to receive and support like poles of adjacent magnets with a ferromagnetic spacer positioned between and contiguous with the polar ends of said magnets.

14. The device according to claim 1 or 3 wherein the surfaces of said end support members in one of said magnet assemblies and the oppositely disposed surfaces of the end support members in an adjacent magnet assembly are planar and substantially parallel with one another and with the longitudinal axis of said magnet assembly.

15. The device according to claim 3 wherein the surfaces of all support members in said magnet assemblies which are oppositely disposed to surfaces of the support members in an adjacent magnet assembly are planar and substantially parallel with one another and with the longitudinal axis of said magnet assembly.

16. The device according to claim 1 or 3 wherein said permanent magnets are cylindrical in shape.

17. A method for the treatment of a fluid with magnetic lines of force which comprises directing said fluid through at least one passageway defined by spaced-apart and longitudinally coextensive magnet assemblies each comprising at least one tier of at least two permanent magnets magnetized along the longitudinal axis thereof and arranged in coaxial line with like poles adjacent each other, said magnet assemblies being positioned so that the polarities of adjacent polar ends of magnets in one of said magnet assemblies are unlike the polarities of the oppositely disposed polar ends of magnets in a spaced-apart magnet assembly, thereby treating said fluid with at least three concentrated flux lines of force and adjacent flux lines of reverse polarity in each said passageway.

* * * * *